US010443815B2

(12) United States Patent
Longoni

(10) Patent No.: US 10,443,815 B2
(45) Date of Patent: Oct. 15, 2019

(54) SCIALYTIC LED LAMP, PARTICULARLY FOR OPERATING ROOMS AND THE LIKE

(71) Applicant: RIMSA P. LONGONI S.R.L., Seregno (IT)

(72) Inventor: Paolo Longoni, Mariano Comense (IT)

(73) Assignee: RIMSA P. LONGONI S.R.L., Seregno (IT)

( * ) Notice: Subject to any disclaimer, the term of this patent is extended or adjusted under 35 U.S.C. 154(b) by 51 days.

(21) Appl. No.: 15/346,978

(22) Filed: Nov. 9, 2016

(65) Prior Publication Data

US 2017/0130932 A1 May 11, 2017

(30) Foreign Application Priority Data

Nov. 9, 2015 (IT) ..... 102015000070205

(51) Int. Cl.
*F21V 7/00* (2006.01)
*F21V 29/503* (2015.01)
(Continued)

(52) U.S. Cl.
CPC ..... *F21V 7/0033* (2013.01); *F21V 3/049* (2013.01); *F21V 7/0058* (2013.01);
(Continued)

(58) Field of Classification Search
CPC ..... F21W 2131/20; F21W 2131/202; F21W 2131/205; F21W 2131/208; F21V 13/04; F21V 41/365; A61B 90/30
(Continued)

(56) References Cited

U.S. PATENT DOCUMENTS 4,135,231 A * 1/1979 Fisher ..... F21V 7/0025 362/269
4,280,167 A 7/1981 Ellett
(Continued)

FOREIGN PATENT DOCUMENTS

DE 102005036275 A1 2/2007
EP 2863112 A1 4/2015
(Continued)

OTHER PUBLICATIONS

EP Search Report dated Dec. 9, 2016 re: Application No. EP 16 19 7780; pp. 1-6; citing: JP 2010 277826 A, KR 2012 0090674 A, US 2009/021931 A1, US 4 280 167 A, US 2011/069485 A1, EP 2 863 112 A1, US 7 972 036 B1 and DE 10 2005 036275 A1.

*Primary Examiner* — Ang T Mai
*Assistant Examiner* — Michael Chiang
(74) *Attorney, Agent, or Firm* — Cantor Colburn LLP

(57) ABSTRACT

A scialytic LED lamp, particularly for operating rooms and the like, includes
- a first ring that includes a plurality of first LED light sources,
- first and second annular reflectors,
- and a second ring that includes a plurality of second LED light sources,
- a third annular reflector,
- and a fourth annular reflector. The scialytic LED lamp also includes
- a first light radiation emitted by the first LED light sources reflected initially by the first annular reflector and then by the second annular reflector in order to illuminate an operating area. A second light radiation emitted by the second LED light sources is reflected initially by the third annular reflector and then by the fourth annular reflector in order to illuminate the operating area.

19 Claims, 12 Drawing Sheets

(51) Int. Cl.

| | |
|---|---|
| ***F21V 29/70*** | (2015.01) |
| ***F21V 3/04*** | (2018.01) |
| ***F21V 7/04*** | (2006.01) |
| ***F21V 13/04*** | (2006.01) |
| ***F21V 21/40*** | (2006.01) |
| ***F21V 23/00*** | (2015.01) |
| ***F21V 23/04*** | (2006.01) |
| ***H05B 33/08*** | (2006.01) |
| *F21W 131/20* | (2006.01) |
| *F21Y 103/33* | (2016.01) |
| *F21Y 105/18* | (2016.01) |
| *F21Y 115/10* | (2016.01) |

(52) U.S. Cl.
CPC ..... *F21V 7/0083* (2013.01); *F21V 7/048* (2013.01); *F21V 13/04* (2013.01); *F21V 21/403* (2013.01); *F21V 23/003* (2013.01); *F21V 23/04* (2013.01); *F21V 29/503* (2015.01); *F21V 29/70* (2015.01); *H05B 33/0845* (2013.01); *H05B 33/0857* (2013.01); *F21W 2131/20* (2013.01); *F21Y 2103/33* (2016.08); *F21Y 2105/18* (2016.08); *F21Y 2115/10* (2016.08)

(58) Field of Classification Search
USPC ..... 362/241, 804
See application file for complete search history.

(56) References Cited

U.S. PATENT DOCUMENTS 4,617,619 A * 10/1986 Gehly ..... F21V 7/22 362/282
4,651,257 A * 3/1987 Gehly ..... F21V 7/09 362/241
6,513,962 B1 * 2/2003 Mayshack ..... F21V 3/04 362/33
6,863,422 B2 * 3/2005 Jesurun ..... F21V 21/403 362/295
7,972,036 B1 * 7/2011 Schach ..... F21S 8/083 362/249.06
8,911,106 B2 * 12/2014 Sato ..... F21S 8/061 362/241
2006/0109664 A1 * 5/2006 Hunerbein ..... F21V 21/40 362/382
2008/0304281 A1 12/2008 Scholz
2009/0021931 A1 * 1/2009 Mayer ..... F21V 7/04 362/235
2009/0122536 A1 * 5/2009 Scholz ..... F21S 2/00 362/234
2011/0048162 A1 * 3/2011 Miura ..... G05G 1/06 74/523
2011/0069485 A1 3/2011 Jacobi
2014/0168966 A1 * 6/2014 Chen ..... F21V 7/0025 362/232
2015/0153027 A1 * 6/2015 Ma ..... F21V 7/00 362/294
2015/0159818 A1 * 6/2015 Dong ..... H05B 33/0854 315/151
2016/0282630 A1 * 9/2016 Valteau ..... G02B 27/1006

FOREIGN PATENT DOCUMENTS

JP 2010277826 A 12/2010
KR 20120090674 A 8/2012

* cited by examiner

SCIALYTIC LED LAMP, PARTICULARLY FOR OPERATING ROOMS AND THE LIKE

CROSS REFERENCE TO RELATED APPLICATIONS

This application is related to and claims the benefit of Italian Patent Application No. 102015000070205, filed on Nov. 9, 2015, the contents of which are herein incorporated by reference in their entirety.

TECHNICAL FIELD

The present disclosure relates to a scialytic LED lamp, particularly for operating rooms and the like.

BACKGROUND

As is known, light affects decisively the operating capabilities of an operator. Optimum lighting creates comfort conditions, reduces the degree of stress, reduces the feeling of fatigue and ultimately increases the efficiency and precision of an operator, such as for example a surgeon.

The quality of artificial lighting is therefore of primary importance, particularly in operating rooms, where the following lighting factors take on a fundamental role:

- the Chromaticity Rendering Index (CRI);
- the visual perception of white, without shades of color, i.e., the so-called color temperature, which can be measured in degrees Kelvin (K);
- the scialytic effect, i.e., the creation of light spots such as to reduce as much as possible the shadows generated by the objects arranged between the light source and the operating field, such as for example the head or the hands of the surgeon and of other operators, or also the tools and surgical instruments used.

Scialytic lamps capable of reproducing in an optimum manner all three of the above factors, and therefore capable of ensuring the fidelity of what the surgeon sees during the procedure, are currently not known.

SUMMARY

The aim of the present disclosure is to provide a scialytic LED lamp, particularly for operating rooms and the like, that solves the technical problem described above, obviates the drawbacks and overcomes the limitations of the background art.

Within this aim, the present disclosure provides a scialytic LED lamp that allows to vary the lighting characteristics as a function of the requirements of the operator.

The disclosure further provides a scialytic LED lamp that is efficient and durable.

The disclosure further provides a scialytic LED lamp that is capable of giving the greatest assurances of reliability and safety in use.

The disclosure also provides a scialytic LED lamp that is easy to provide and economically competitive if compared with the background art.

These advantages will become better apparent hereinafter and are achieved by providing a scialytic LED lamp, particularly for operating rooms and the like, further comprising:

- a first ring that comprises a plurality of first LED light sources,
- a first annular reflector,
- a second annular reflector,
- a second ring that comprises a plurality of second LED light sources,
- a third annular reflector,
- a fourth annular reflector, a first light radiation emitted by said first LED light sources being reflected initially by said first annular reflector and then by said second annular reflector in order to illuminate an operating area, a second light radiation emitted by said second LED light sources being reflected initially by said third annular reflector and then by said fourth annular reflector in order to illuminate said operating area.

BRIEF DESCRIPTION OF THE DRAWINGS

Further characteristics and advantages of the present disclosure will become better apparent from the description of a preferred but not exclusive embodiment of a scialytic LED lamp, particularly for operating rooms and the like, illustrated by way of nonlimiting example with the aid of the accompanying drawings, wherein.

DETAILED DESCRIPTION OF THE DRAWINGS

Figure 1:
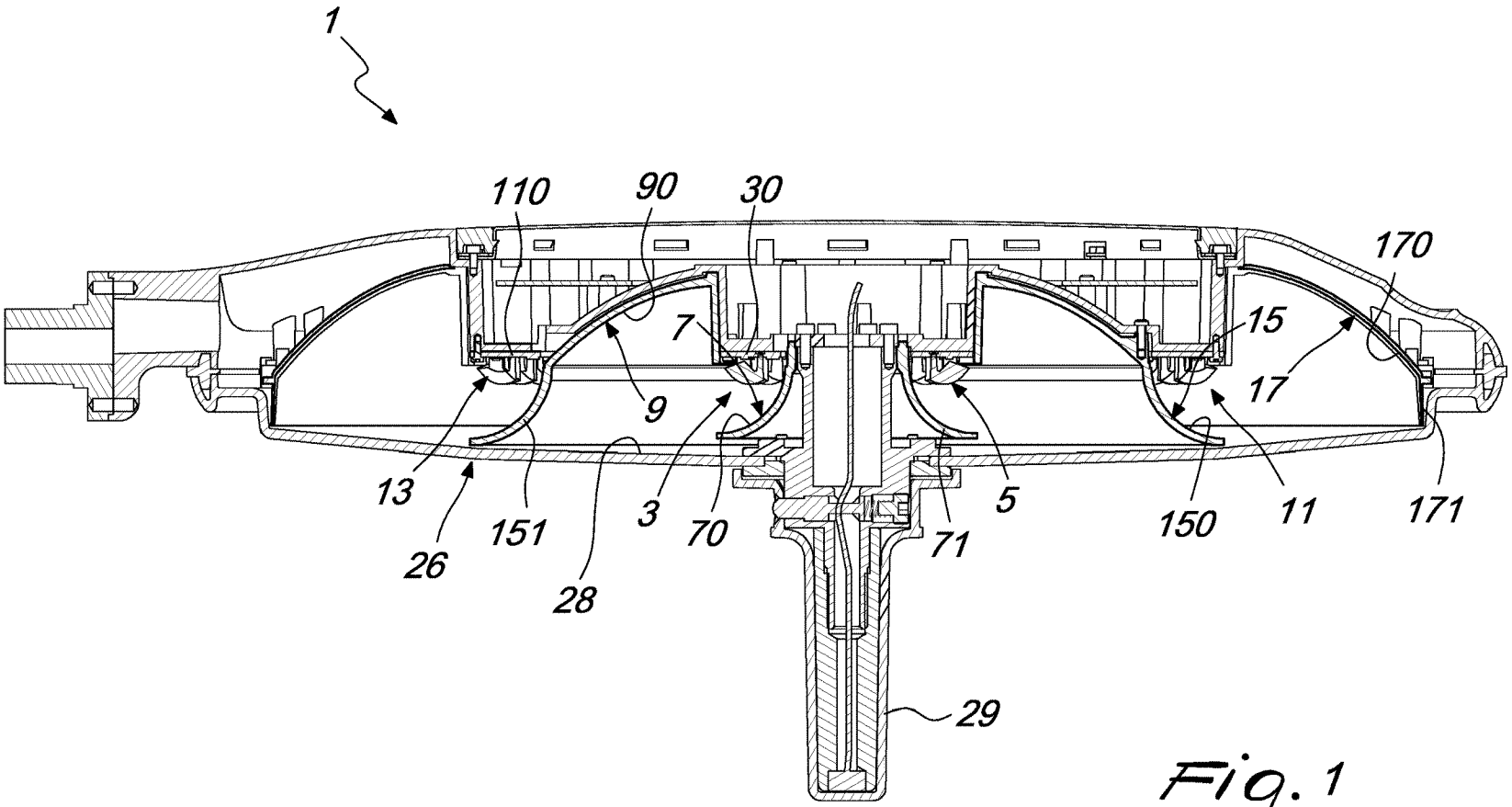
FIG. 1 is a front sectional view of an embodiment of a scialytic LED lamp according to the disclosure.

With reference to the cited figures, a scialytic LED lamp particularly for operating rooms and the like is designated generally by the reference numeral 1.

According to the disclosure, the lamp comprises:

- a first ring 3 that comprises a plurality of first LED light sources 5,
- a first annular reflector 7,
- a second annular reflector 9,
- a second ring 11 that comprises a plurality of second LED light sources 13,
- a third annular reflector 15,
- a fourth annular reflector 17.

According to the disclosure, the light radiation 19 emitted by the first LED light sources 5 is reflected initially by the first annular reflector 7 and then by the second annular reflector 9 in order to illuminate an operating area. Likewise, the light radiation 21, 22 emitted by the second LED light sources 13 is reflected initially by the third annular reflector 15 and then by the fourth annular reflector 17 in order to illuminate said operating area.

Figure 5:
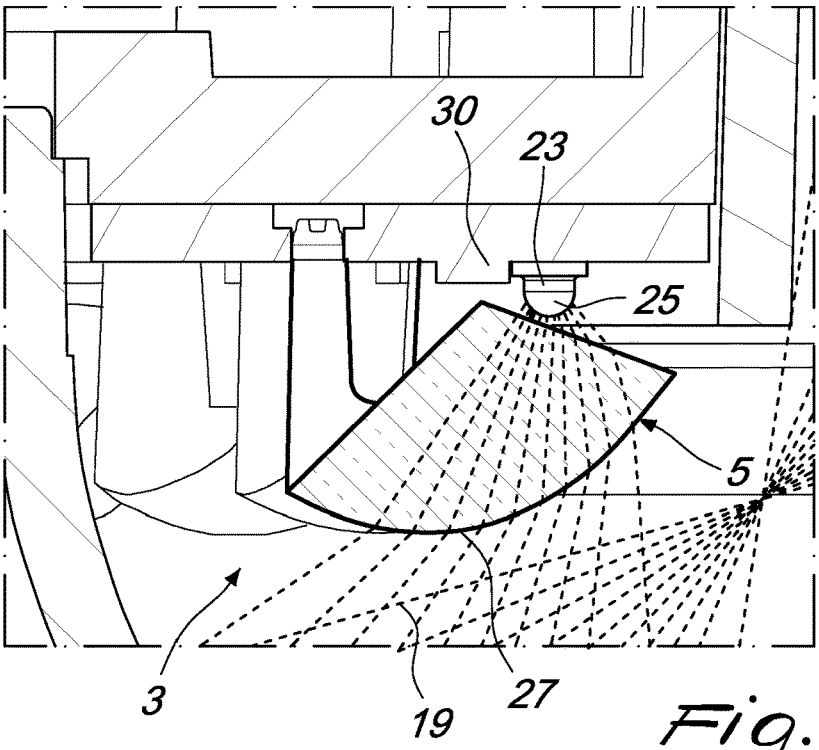
FIG. 5 is an enlarged-scale view of a portion of FIG. 2, showing in particular an LED light source of the lamp according to the disclosure.
Figure 6:
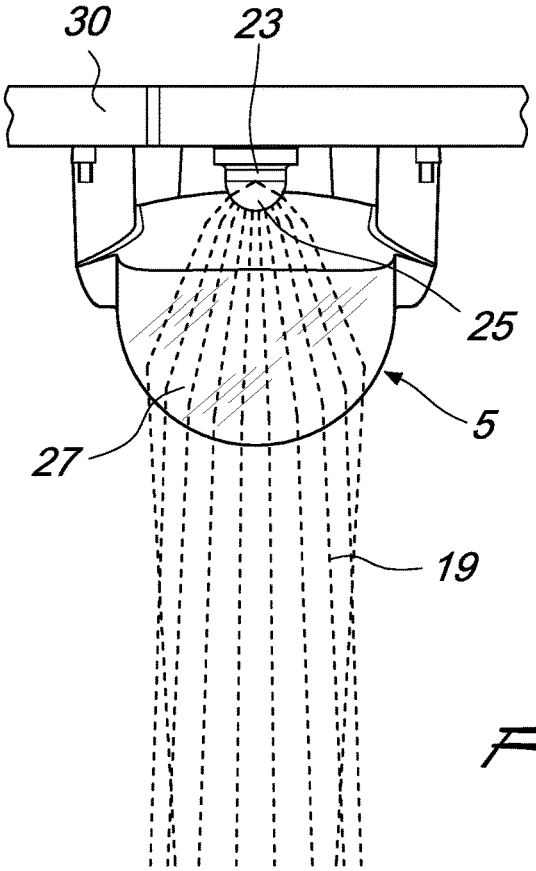
FIG. 6 is a schematic view of the LED light source of FIG. 5, taken at right angles with respect to the front view of FIG. 5.
Figure 7:
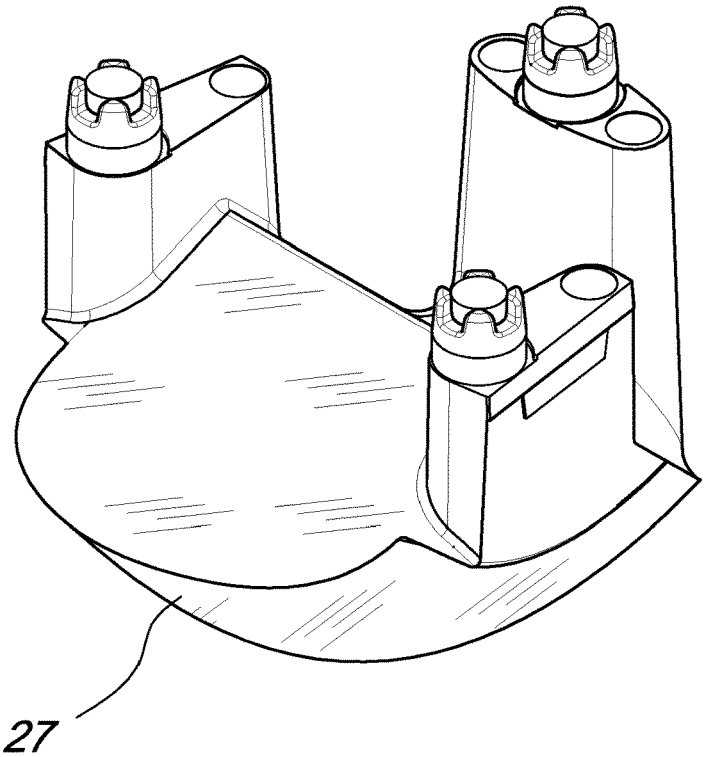
FIGS. 7 and 8 are perspective views of a lens associated with the LED light sources of the lamp of FIG. 1 according to the disclosure.
Figure 8:
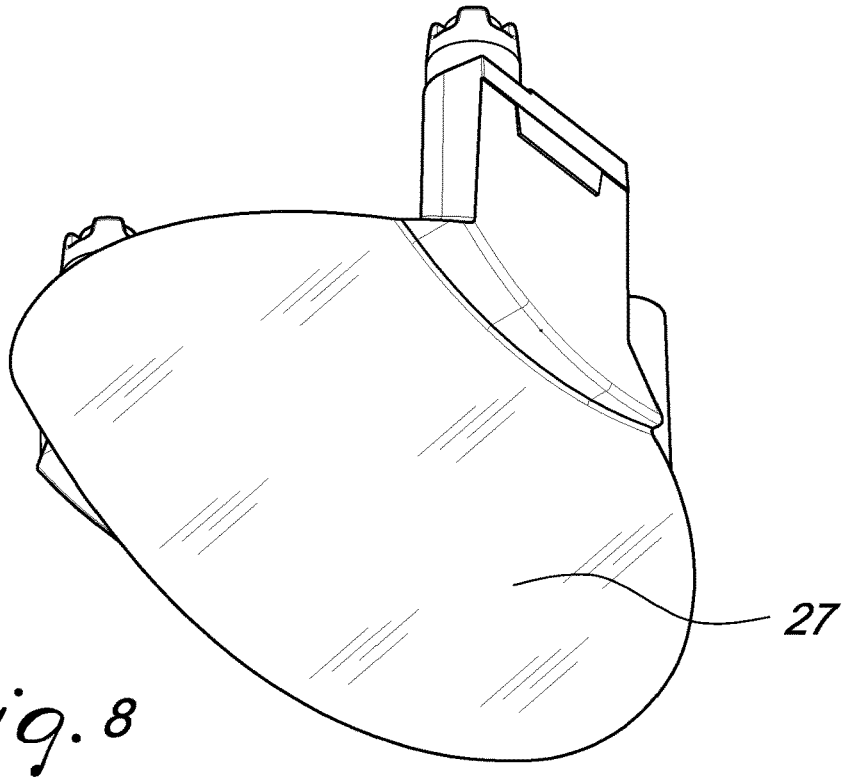

Advantageously, as shown in particular in FIGS. 5 and 6 with reference to the first LED light sources 5, the first light sources 5 and the second light sources 13 each comprise at least one LED 23, at least one primary lens 25 and at least one secondary lens 27.

As shown in particular in FIGS. 2 to 5, the secondary lens 27 is configured to direct respectively the first light radiation 19 toward the first annular reflector 7 and the second light radiation 21, 22 toward the third annular reflector 15.

Advantageously, the primary lens 25 is integrated with the LED 23. Equally advantageously, the primary lens 25 has a hemispherical shape configured to direct the light beam emitted by the LED 23 toward the secondary lens 27.

As shown in FIGS. 5 to 8, the secondary lens 27 advantageously has a shape that is configured to widen, on the front plane, the light beam that passes through said lens so as to direct it toward the first reflector 7 or toward the third reflector 15.

As shown in FIG. 6, the shape of the secondary lens 27 is also configured advantageously in order to keep the rays of the light beam that passes through the secondary lens 27 substantially parallel to each other on a plane that is perpendicular to the front plane.

Advantageously, at least one between the first annular reflector 7 and the third annular reflector 15 comprises a reflective surface 70, 150 that is divided into sectors. Preferably, both annular reflectors 7 and 15 comprise a reflective surface 70, 150 divided into sectors.

In particular, the number of sectors present on the reflective surface 70 of the first annular reflector 7 can correspond to the number of the first LED light sources 5, while the number of sectors present on the reflective surface 150 of the third annular reflector 15 can correspond to the number of the second LED light sources 13.

In other words, a sector of the reflective surfaces 70 and 150 of the corresponding reflectors 7 and 15 is advantageously associated with each LED light source 5, 13. In particular, the configuration of the secondary lens 27 is adapted to guide the rays of the light beam emitted by each LED 23 toward a corresponding sector of the reflective surfaces 70 and 150.

Advantageously, at least one between the second annular reflector 9 and the fourth annular reflector 17 comprises a substantially uniform and continuous reflective surface 90, 170. Preferably, both annular reflectors 9 and 17 comprise a substantially uniform and continuous reflective surface 90 and 170.

In this manner, the light rays that exit from the secondary lens 27 of each LED light source 5 and/or 13 can undergo a first reflection at a sector of the reflective surface divided into sectors 70 and/or 150 and then a second reflection at the uniform and continuous reflective surface 90 and/or 170. The first reflection, in sectors, has the advantage of utilizing the integrity of the light stream that arrives from the secondary lenses 27, each of which is indeed configured advantageously to direct the light beam to a specific sector, thus reducing light scattering. The second reflection instead has the effect of mixing the light and making it uniform, layered and in depth, in order therefore to ensure a cylindrical light beam without shadows.

Advantageously, the reflective surfaces comprise highly reflective polished mirrors with high reflectivity, which have been subjected to a vacuum metallization treatment.

Figure 9:
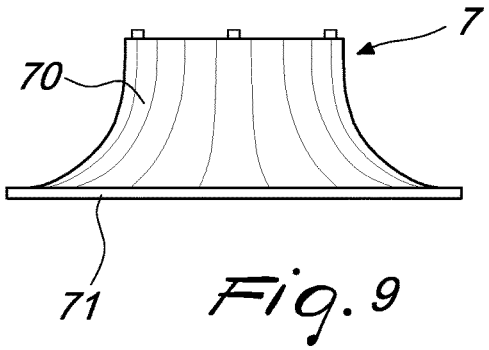
FIG. 9 is a front view of a component of the lamp of FIG. 1 according to the disclosure.
Figure 10:
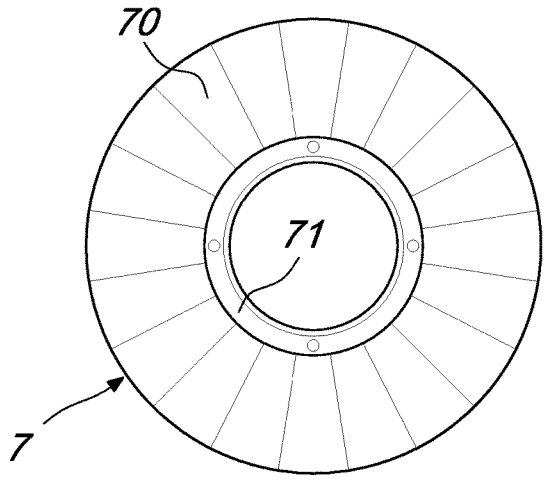
FIG. 10 is a top plan view of the component of FIG. 9.

As shown in FIGS. 9 and 10, the lamp 1 can comprise a first annular body 71 that forms the first annular reflector 7.

Figure 11:
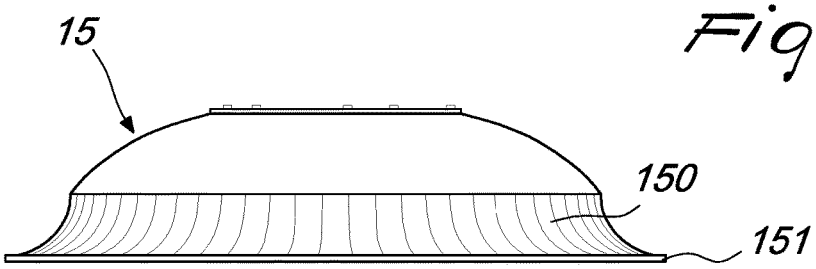
FIG. 11 is a front view of another component of the lamp of FIG. 1 according to the disclosure.
Figure 12:
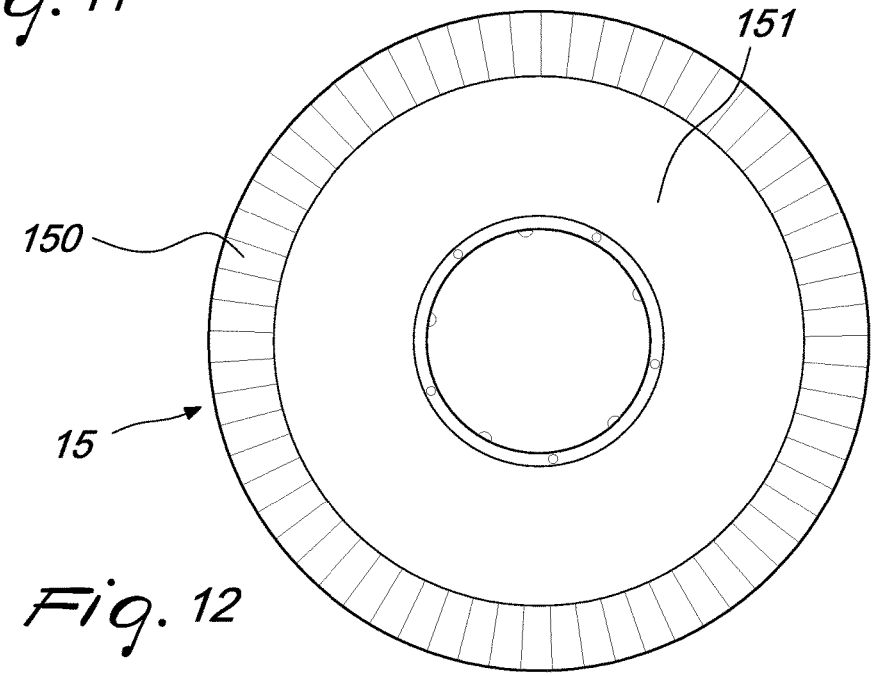
FIG. 12 is a top plan view of the component of FIG. 11.

As shown in FIGS. 11 and 12, the lamp 1 can comprise a second annular body 151, which forms both the second annular reflector 9, at the internal surface of the internal radial portion, and the third annular reflector 15, at the external surface of the outermost radial portion.

Figure 13:
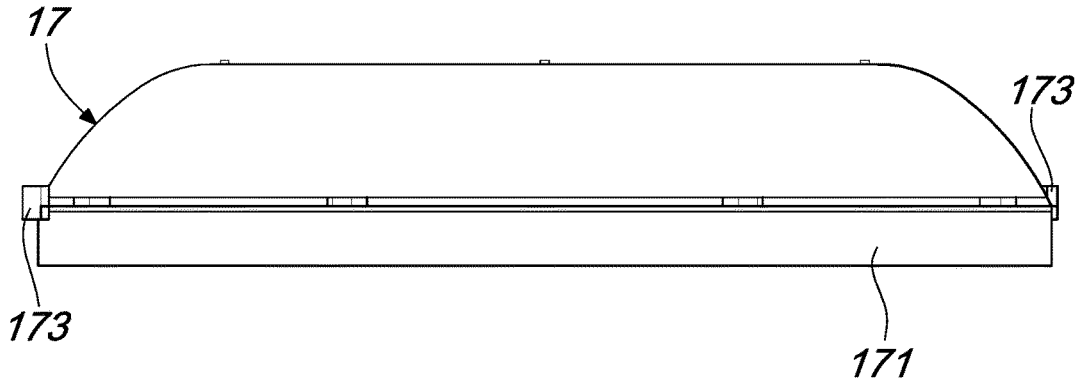
FIG. 13 is a front view of another component of the lamp of FIG. 1 according to the disclosure.
Figure 14:
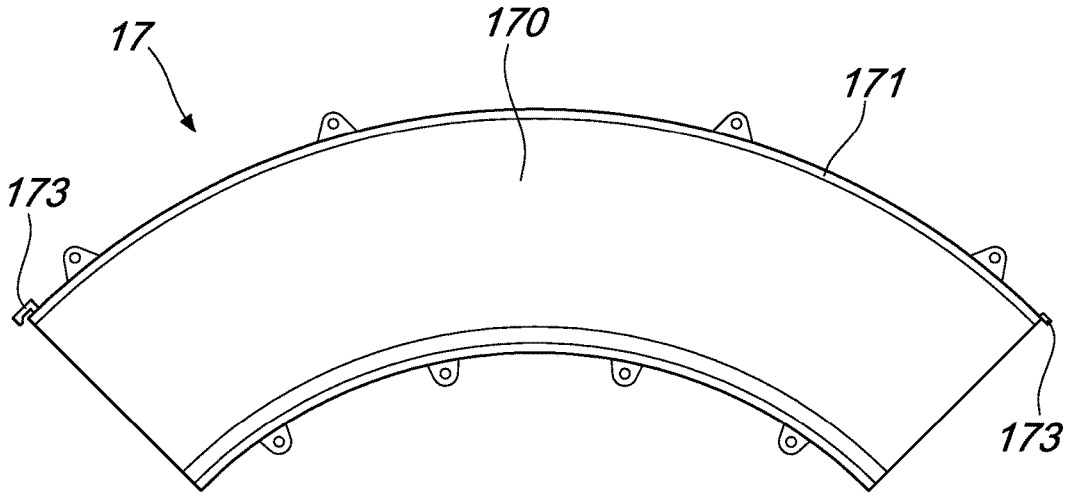
FIG. 14 is a bottom plan view of the component of FIG. 13.
Figure 15:
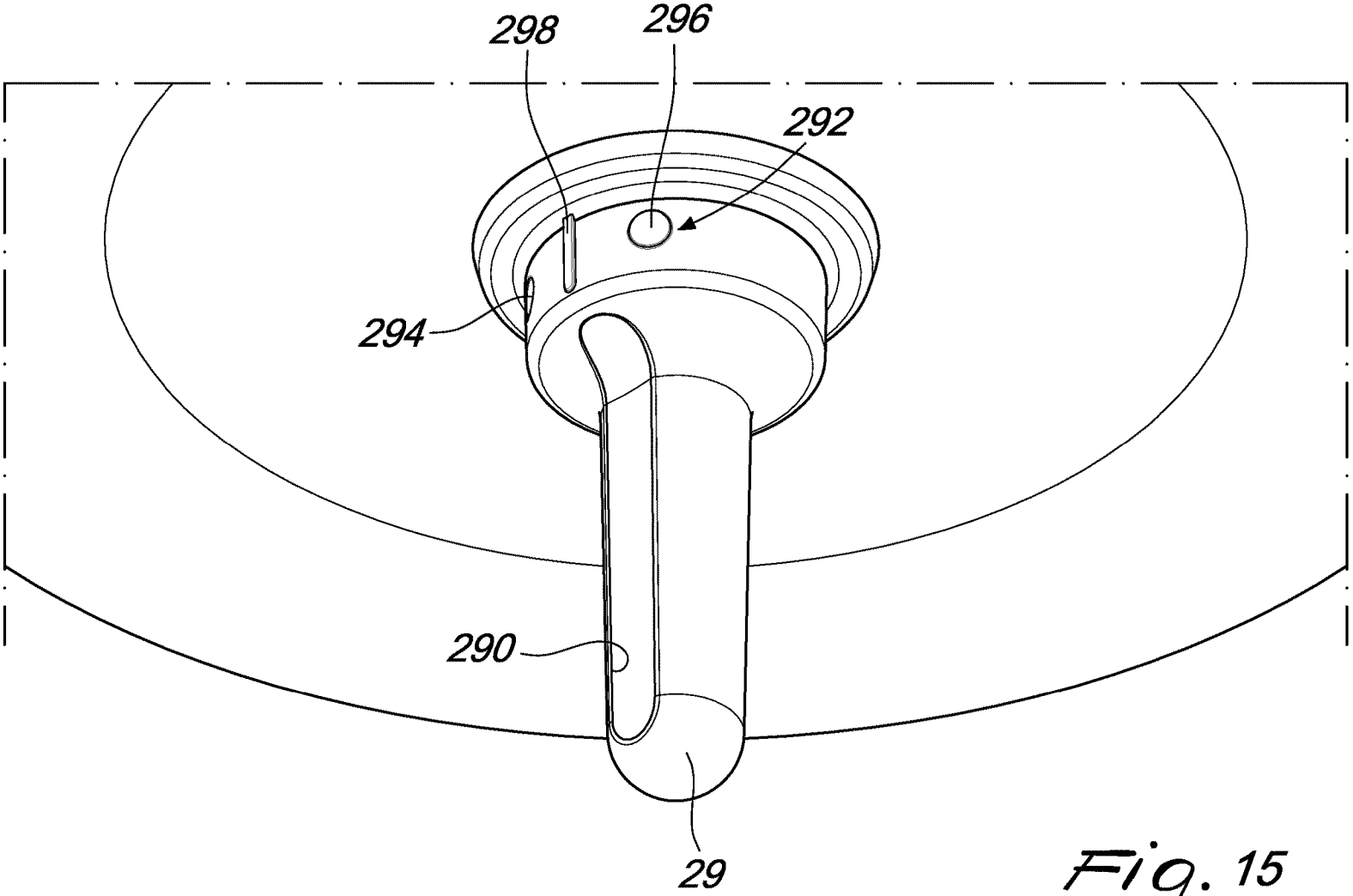
FIG. 15 is a perspective view of the orientation handle of the lamp of FIG. 1, according to the disclosure.

Furthermore, as shown in FIGS. 13 and 14, the lamp 1 can comprise a third annular body 171, which forms the fourth annular reflector 17. FIGS. 13 and 14 show in particular only one of the four sectors that form the annular body 171. These sectors advantageously can be mutually associated by means of hooks 173.

Advantageously, the first, second and third annular bodies 71, 151 and 171 can be arranged substantially concentrically and can lie at a same horizontal plane.

Advantageously, the first ring 3 and/or the second ring 11 comprise an annular base 30, 110 with which the LED light sources 5, 13 are associated. The annular base 30, 110 is advantageously made of a material that is adapted to dissipate the heat generated by the LED light sources 5, 13. Correct dissipation of the heat generated by the LEDs 23 is in fact suitable to ensure higher efficiency and constancy of lighting as well as a longer operating life of said LEDs.

The annular bases 30 and 110 are advantageously made of a material of the type of aluminum alloy, which allows, by means of the insertion of electrical conducting tracks made of copper, alternated with planes of dielectric material (PCB), also the soldiering of the LEDs 23 thereon, by means of automated technologies.

Advantageously, the first ring 3 and the second ring 11 can be concentric and coplanar.

Advantageously, the radially outermost ring 11, which has a larger diameter, can comprise a larger number of LED light sources 13 than the number of sources 5 that are present on the radially innermost ring 3.

For example, the outer ring 11 can comprise sixty-four LED light sources 13, while the inner ring 3 can comprise twenty of them.

The LED light sources 5, 13 can be arranged conveniently on the respective ring 3, 11 so as to generate a light radiation that is adapted to strike mainly the central region of the operating area to be illuminated, or a light radiation that is adapted to strike mainly the lateral regions with respect to the center of the operating area to be illuminated.

Figure 2:
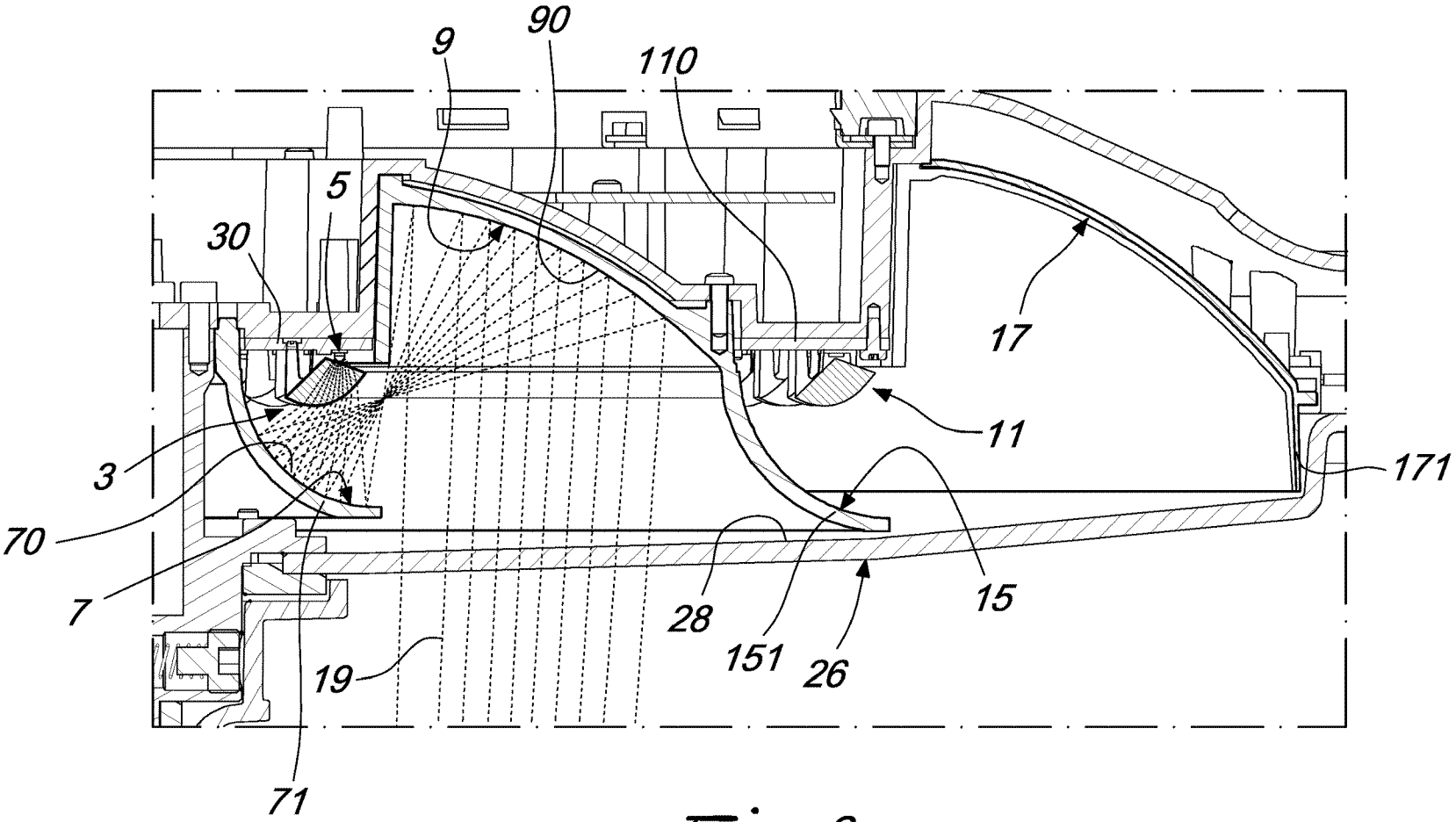
FIGS. 2, 3, and 4 are enlarged-scale views of portions of FIG. 1, which show in particular the paths of three different light radiations emitted by the lamp according to the disclosure.

In this regard, FIG. 2 shows the light radiation 19 emitted by the first LED light sources 5 of the first ring 3 and conveniently reflected by the first reflector 7 and by the second reflector 9. This light radiation 19 is advantageously adapted to strike the central region of the operating area of interest.

Figure 3:
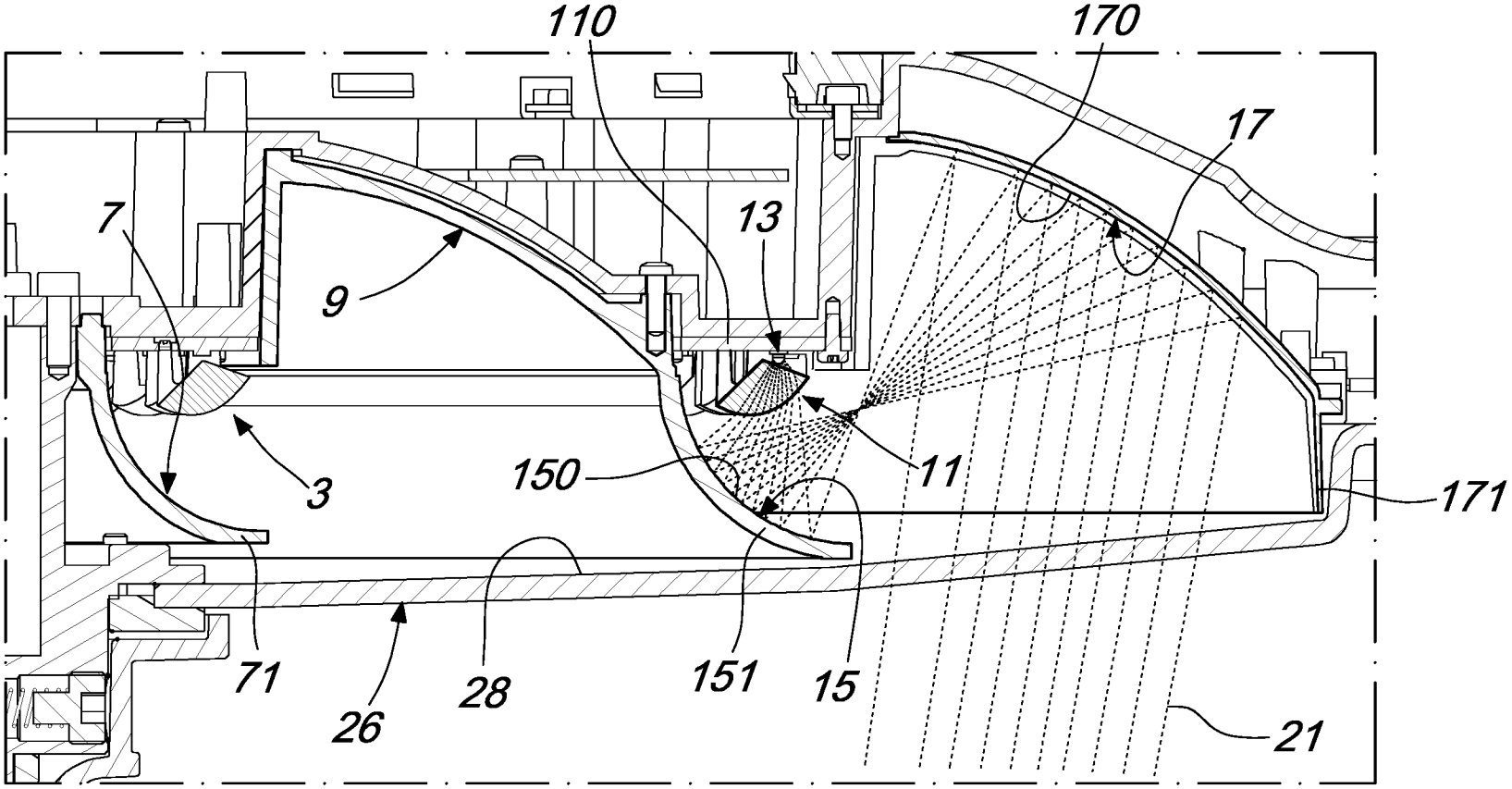

FIG. 3 shows the light radiation 21 emitted by a first group of the second LED light sources 13 of the second ring 11 and appropriately reflected by the third reflector 15 and by the fourth reflector 17. This light radiation 21, too, is advantageously adapted to strike the central region of the operating area of interest.

Figure 4:
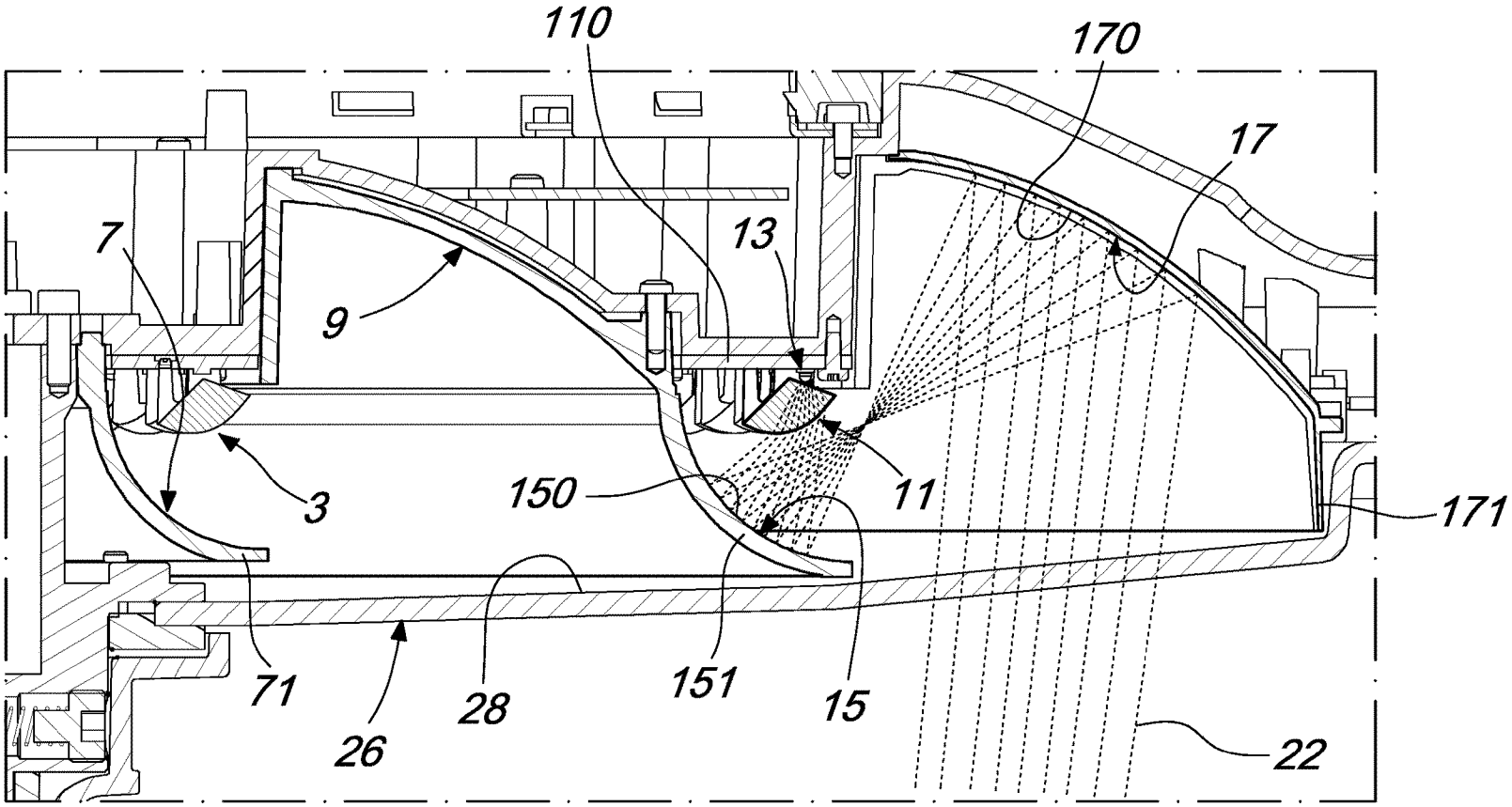

FIG. 4 instead shows the light radiation 22 emitted by a second group of the second LED light sources 13 of the second ring 11, and conveniently reflected by the third reflector 15 and by the fourth reflector 17. This light radiation 22 is instead advantageously adapted to strike the lateral regions of the operating area of interest.

Advantageously, in fact, the LED light sources 13 of the second ring 11 are arranged so as to be slightly radially offset with respect to each other, so that a first group thereof, which is radially slightly closer to the center, directs its lighting toward the center of the operating area, while a second group thereof, which is radially slightly further from the center, directs its lighting toward lateral regions of the operating area of interest.

Advantageously, the scialytic LED lamp 1 comprises a substantially transparent closure dome 26, the internal surface 28 of which has a surface roughness that is configured to diffuse the light radiations 19, 21 and 22 in order to mix the light further. The internal surface 28 has advantageously a roughness value Ra comprised in the interval between 0.4 and 3.2 micrometers.

The closure dome 26 is advantageously made of a material of the type of polycarbonate, with a wear-resistant treatment of the outer surface.

The LEDs 23 of the LED light sources 5, 13 advantageously have a white base hue, but with different color temperatures, from warm white to neutral white to cold white.

Advantageously, the lamp 1 can comprise LEDs 23 that are variously suitable to generate a warm white light radiation, for example having a color temperature of approximately 3000 K, or a neutral white light radiation, for example having a color temperature of approximately 4500 K, or a cold white light radiation, for example having a color temperature of approximately 6500 K.

Advantageously, in the upper region of the lamp 1 it is possible to provide an additional ring of LEDs, covered by a silicone dome and adapted to softly illuminate the ceiling in order to generate a courtesy light.

Advantageously, the lamp 1 comprises a handle 29, which is adapted to allow the orientation of the lamp 1 by the operator. The handle 29 preferably can be sterilized at least partially. Advantageously, the adjustment of the brightness and/or of the color temperature of the light emitted by the lamp 1 is adjustable from the handle 29.

Advantageously, the handle 29 has a longitudinal recess 290 which is adapted to guide the finger of the user along the handle 29 until it reaches means 292 for adjusting the brightness and/or color temperature of the light emitted by the lamp 1.

The adjustment means 292 can comprise for example a pair of buttons 294 and 296 assigned respectively to reducing and increasing the brightness emitted by the lamp 1.

Advantageously, between the buttons 294 and 296 it is possible to provide an additional tactile locator element 298.

In this manner, the operator who grips the handle 29 can easily reach the adjustment means 292 without having to take his eyes off the operating work area, simply by sliding his thumb along the longitudinal recess 290 that is present on the handle 29 until the tactile locator element 298 is reached and therefore until one of the two buttons 294, 296 for adjusting the brightness of the lamp 1 is reached.

Advantageously, the maximum vertical space occupation of the body of the lamp 1 is less than 100 mm, excluding the handle 29.

The scialytic LED lamp 1 advantageously comprises an electronic circuit for the power supply and control of the first LED light sources 5 and/or of the second LED light sources 13, which is adapted to deliver values of electric current that can vary with a resolution of approximately 5 mA and a tolerance of approximately +/−2 mA, in order to be able to perform stably and precisely the brightness and color temperature adjustments depending on the requirements of the operator.

Advantageously, the LEDs 23 can be connected to each other in groups, in series, depending on the function that they have to perform, for example according to the possibility to adjust the color temperature, or according to their use in order to illuminate the center of the operating area rather than the lateral regions. Advantageously, all the LEDs 23 have Zener diodes in parallel which are adapted to ensure the continuity of operation of the entire series of LEDs 23 in case of failure of a single LED 23.

For example, it is possible to distribute on the first ring 3, on a total of twenty, twelve neutral white LEDs, four warm white LEDs, and four cold white LEDs, all dedicated to providing light to the central region of the operating area, while on the second ring 11 it is possible to distribute, on a total of sixty-four, forty neutral white LEDs, twelve warm white LEDs, twelve cold white LEDs, twenty-four LEDs of which are dedicated to generating the widening of the illuminated diameter.

The power supply and control circuit allows to manage advantageously the following basic functions:

- turning the lamp 1 on and off,
- adjusting the brightness, for example in seven different levels, by means of a panel of the touch type, or by means of remote control, or again by virtue of adjustment means that are present on the sterilizable handle 29 of the lamp 1;
- adjusting the desired color temperature, for example in seven different levels;
- changing the luminous diameter on the operating area in an electronic and nonmechanical manner by turning on the LEDs assigned to lighting the lateral regions of the operating area;
- setting an "endoscopy light" mode by turning on only a small number of LEDs;
- setting a "courtesy light" mode.

Advantageously, it is possible to provide for the lamp 1 to also comprise a third ring which comprises a plurality of third LED light sources, the luminous radiation of which undergoes a double reflection by a fifth annular reflector, optionally with a surface divided into sectors, and a sixth annular reflector.

Finally, the lamp according to the disclosure provides for a central body 51 with a covering element 56.

Figure 16:
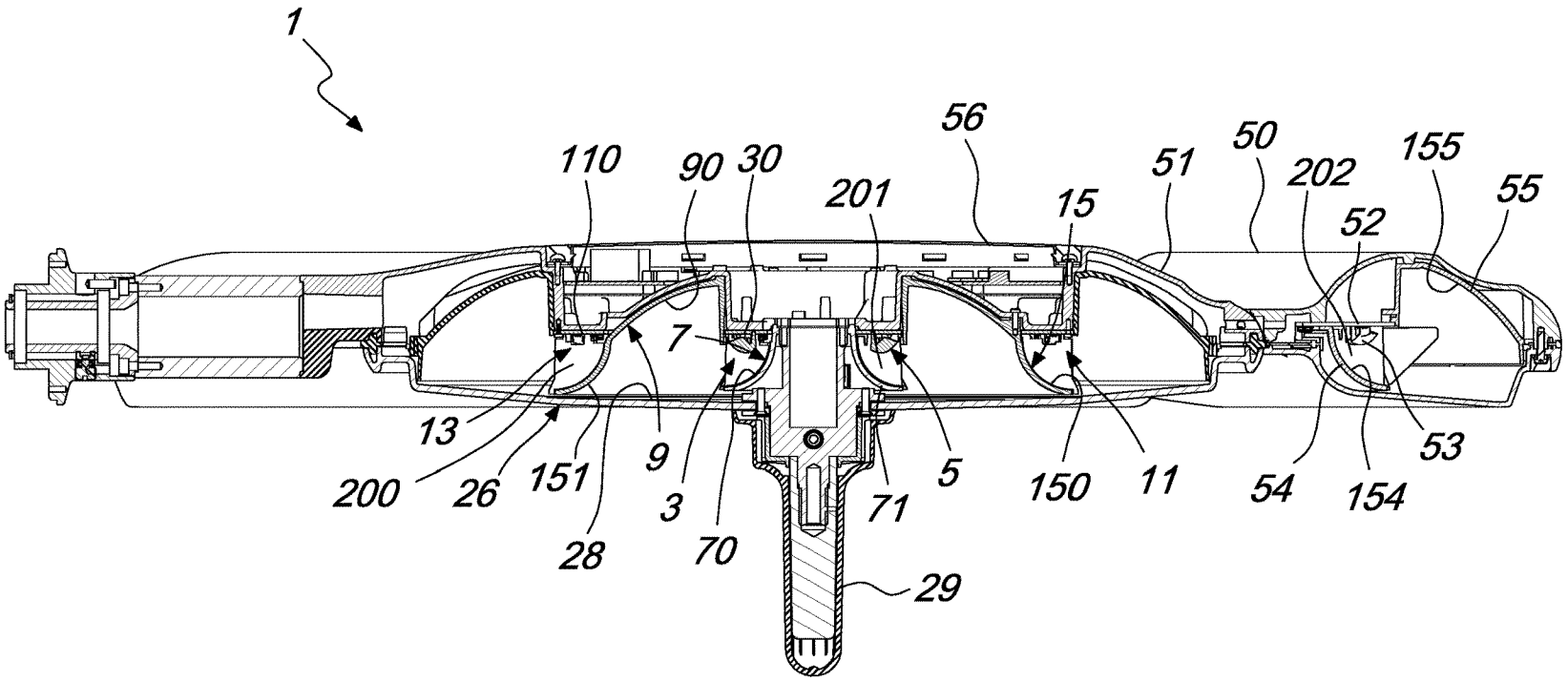
FIG. 16 is a front sectional view of another embodiment of the lamp according to the present disclosure.
Figure 17:
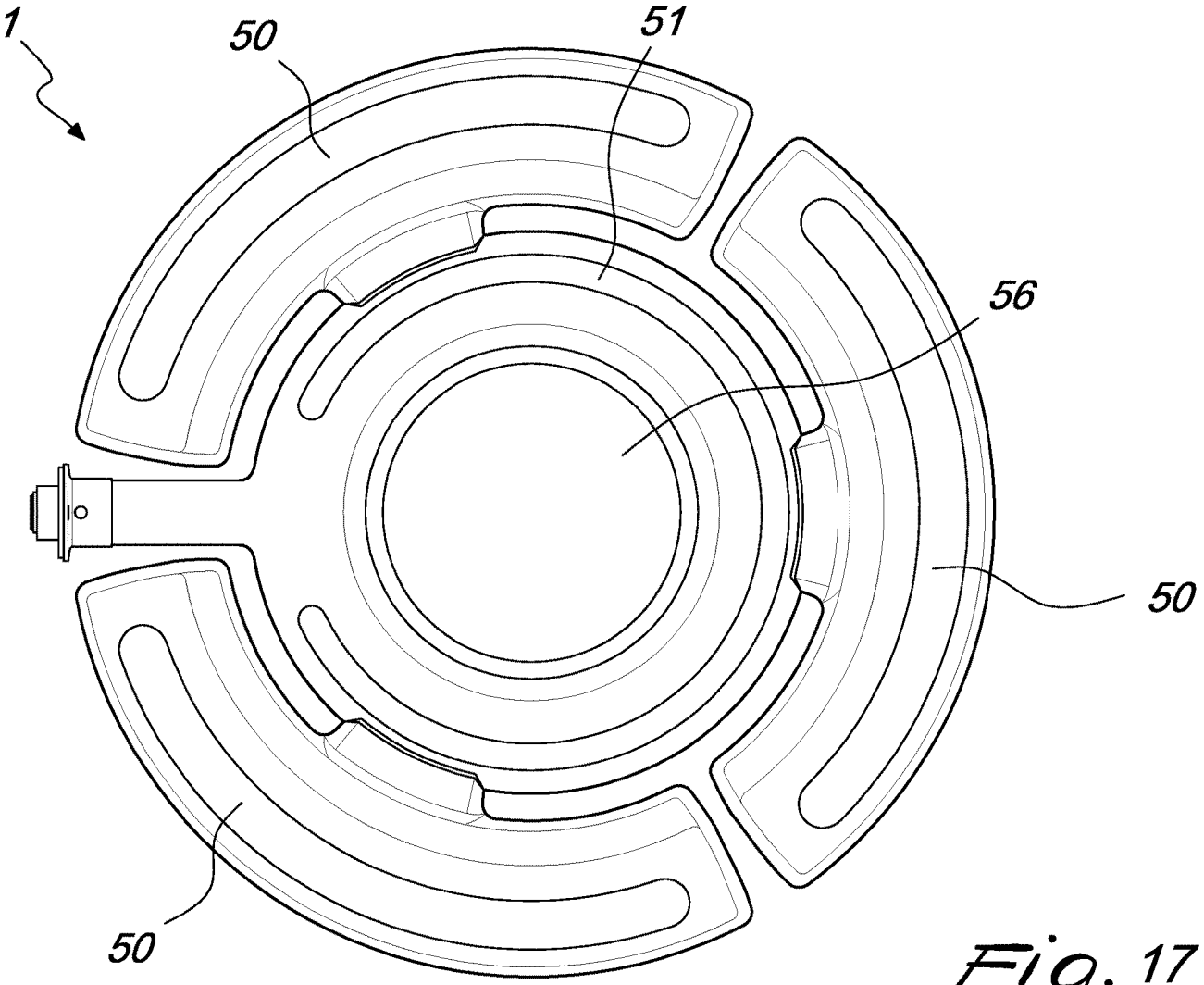
FIG. 17 is a top plan view of the lamp shown in FIG. 16.

FIGS. 16 and 17 show a further embodiment of the lamp according to the disclosure, in which there are light emitting modules 50 anchored to the central body 51 of the lamp.

Conveniently, the modules 50 are three and are such that each one is extended over a sector of approximately 120 degrees for the extension of the luminous emission surface.

In this embodiment there is a third ring 52 (conveniently made of three adjoining circular sectors), which comprises a plurality of third LED light sources 53, a fifth annular reflector 54 with a reflecting surface 154 and a sixth annular reflector 55 with a reflecting surface 155.

The first LED light sources 5, the second LED light sources 13 and the third LED light sources 53 focus the light, at the end of the reflections, respectively at different levels along the vertical axis of the lamp.

Each light source comprises LEDs with three different color temperatures, warm white, natural white and cold white.

In practice it has been found that the scialytic LED lamp, particularly for operating rooms and the like, according to the present disclosure, achieves the intended aim and advantages, since it allows to vary the lighting conditions in an absolutely flexible manner as a function of the requirements of the operator.

Another advantage of the lamp according to the disclosure resides in that it generates a light that avoids any possible dazzling of the operator, for example because the operator can never be struck by the direct light of the LEDs.

A further advantage of the lamp according to the disclosure resides in that it emits light rays in a uniform manner without uncontrolled light spots.

Figure 18:
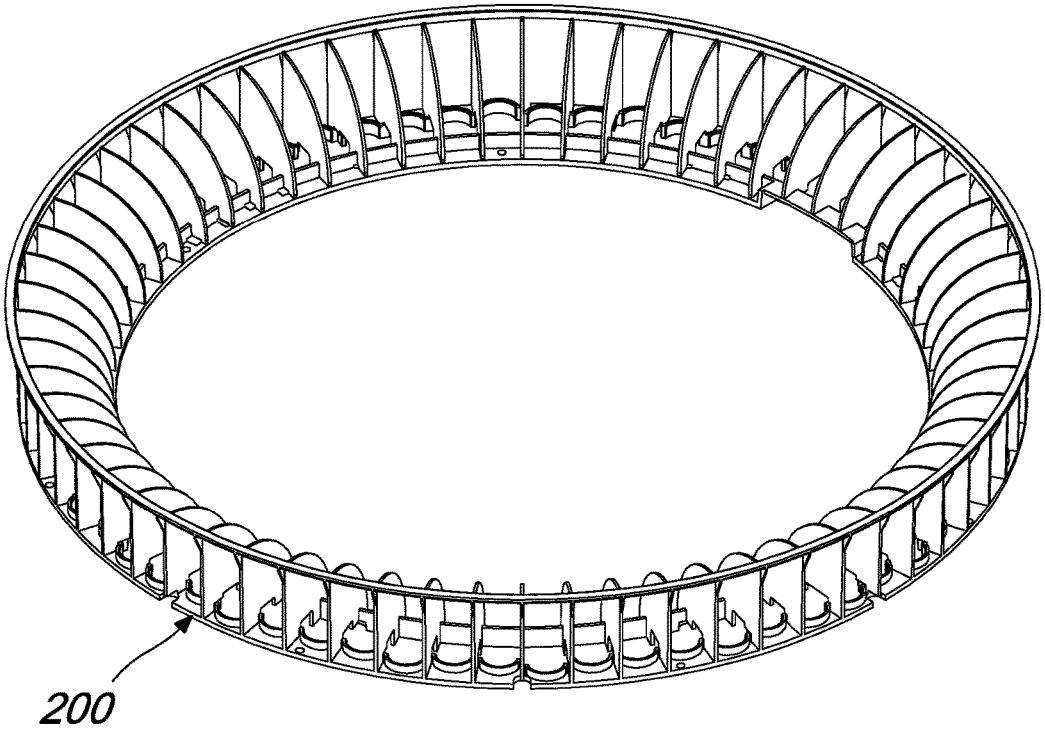
FIGS. 18 and 19 are perspective views of two out of three light guide elements illustrated in the lamp of FIG. 16.
Figure 19:
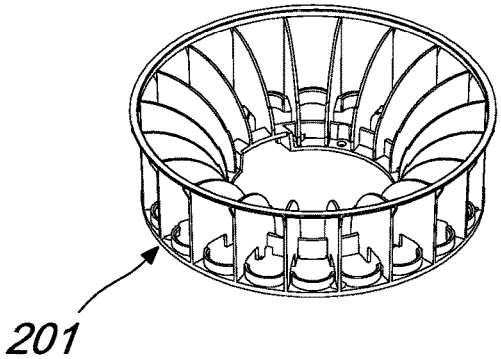

This can be achieved with a ring device (light guide element), as illustrated in perspective view in FIGS. 18 and 19, wherein the ring devices are respectively indicated by the reference numerals 200 and 201.

FIG. 16 illustrates the presence of three ring devices (light guide elements) 200, 201 and 202 arranged at the first reflector 7, third reflector 15 and fifth reflector 54.

The ring device 202 is the same as the ring devices 200 and 201 illustrated in FIGS. 18 and 19.

Another advantage of the lamp according to the disclosure resides in that it improves the scialytic effect both close up and from a distance.

A further advantage of the lamp according to the disclosure resides in that it is possible to adjust digitally the lighting diameter of the operating area.

Another advantage of the lamp according to the disclosure resides in that it generates light rays that are collimated at operating distances comprised between 700 and 2000 mm.

A further advantage of the lamp according to the disclosure resides in that it ensures an optimum and safe thermal management of the LEDs.

The scialytic LED lamp, particularly for operating rooms and the like, thus conceived is susceptible of numerous modifications and variations.

All the details may further be replaced with other technically equivalent elements.

In practice, the materials used, so long as they are compatible with the specific use, as well as the contingent shapes and dimensions, may be any according to the requirements.

What is claimed is:

1. A scialytic LED lamp comprising:

a plurality of LEDs and at least one reflector which directs the light of the LEDs onto an operating field, a first ring that comprises a plurality of first LED light sources, a first annular reflector comprising a first concave reflective surface that is configured to focus a first light radiation emitted by said first LED light sources onto a second annular reflector, said second annular reflector comprising a second concave reflective surface that is configured to focus said first light radiation onto an operating area, said first light radiation being reflected twice, initially by said first annular reflector and then by said second annular reflector, a second ring that comprises a plurality of second LED light sources, a third annular reflector comprising a third concave reflective surface that is configured to focus a second light radiation emitted by said second LED light sources onto a fourth annular reflector, said fourth annular reflector comprising a fourth concave reflective surface configured to focus said second light radiation onto said operating area, said second light radiation being reflected twice, initially by said third annular reflector and then by said fourth annular reflector, and wherein each of said first light sources and each of said second light sources comprise at least one LED, at least one primary lens and at least one secondary lens, said at least one secondary lens of the first and second light sources is configured to respectively direct said first light radiation toward said first annular reflector and said second light radiation toward said third annular reflector.

2. The scialytic LED lamp according to claim 1, wherein at least one between said first concave reflective surface and said third concave reflective surface is divided into sectors.

3. The scialytic LED lamp according to claim 1, wherein at least one between said first concave reflective surface and said third concave reflective surface is divided into sectors, the number of sectors of said first concave reflective surface corresponding to the number of said first LED light sources, the number of sectors of said third concave reflective surface corresponding to the number of said second LED light sources.

4. The scialytic LED lamp according to claim 1, wherein at least one between said second concave reflective surface and said fourth concave reflective surface is substantially uniform and continuous.

5. The scialytic LED lamp according to claim 1, further comprising a substantially transparent closure dome, an internal surface of which has a surface roughness that is configured to diffuse said first light radiation and said second light radiation.

6. The scialytic LED lamp according to claim 1, further comprising an electronic power supply and control circuit for said first LED light sources and said second LED light sources that is adapted to deliver electric current values that are variable with a resolution of approximately 5 mA and a tolerance of approximately +/−2 mA.

7. The scialytic LED lamp according to claim 1, wherein said first ring and said second ring comprise an annular base, with which said first and second LED light sources are associated, said annular base being made of a material that is adapted to dissipate the heat generated by said first and second LED light sources.

8. The scialytic LED lamp according to claim 1, wherein at least one light radiation is directed toward a center of said operating area and wherein at least one other light radiation is directed toward lateral regions of said operating area.

9. The scialytic LED lamp according to claim 1, wherein said first LED light sources and said second LED light sources are configured to emit white light at different color temperatures.

10. The scialytic LED lamp according to claim 1, further comprising a handle, which can be sterilized at least partially, wherein an adjustment of the brightness and color temperature of the light emitted by said lamp is adjustable from said handle.

11. The scialytic LED lamp according to claim 10, wherein said handle has a longitudinal recess that is adapted to guide the finger of the user along said handle until it reaches means for adjusting the brightness and the color temperature of the light emitted by said lamp.

12. The scialytic LED lamp according to claim 1, comprising a central body of said lamp.

13. The scialytic LED lamp according to claim 12, further comprising light emission modules adapted to be anchored to said central body, for the extension of the light emission surface.

14. The scialytic LED lamp according to claim 13, further comprising a plurality of third LED light sources, a fifth reflector, and a sixth reflector.

15. The scialytic LED lamp according to claim 14, further comprising light guide elements arranged at said first annular reflector, said third annular reflector, and said fifth annular reflector.

16. The scialytic LED lamp according to claim 1, further comprising an electronic power supply and control circuit for said first LED light sources or said second LED light sources that is adapted to deliver electric current values that are variable with a resolution of approximately 5 mA and a tolerance of approximately +/−2 mA.

17. The scialytic LED lamp according to claim 1, wherein said first ring or said second ring comprise an annular base, with which said first LED light sources or said second LED light sources are associated, said annular base being made of a material that is adapted to dissipate the heat generated by said first LED light sources or said second LED light sources.

18. The scialytic LED lamp according to claim 1, further comprising a handle, which can be sterilized at least partially, wherein an adjustment of the brightness or color temperature of the light emitted by said lamp is adjustable from said handle.

19. The scialytic LED lamp according to claim 18, wherein said handle has a longitudinal recess that is adapted to guide the finger of the user along said handle until it reaches means for adjusting the brightness or the color temperature of the light emitted by said lamp.

* * * * *